United States Patent [19]

Ura et al.

[11] 4,395,114

[45] Jul. 26, 1983

[54] TONER RECOVERY DEVICE

[75] Inventors: Hiroaki Ura, Kunitachi; Tsugio Hirabayashi; Junichi Koiso, both of Hachioji, all of Japan

[73] Assignee: Konishiroku Photo Industry Co., Ltd., Tokyo, Japan

[21] Appl. No.: 333,623

[22] Filed: Dec. 22, 1981

[30] Foreign Application Priority Data

Dec. 26, 1980 [JP] Japan ..... 55/183882
Dec. 26, 1980 [JP] Japan ..... 55/183883

[51] Int. Cl.[3] ..... G03G 15/00; G03G 15/08

[52] U.S. Cl. ..... 355/15; 355/3 R; 355/3 DD; 355/14 D

[58] Field of Search ..... 355/3 R, 15, 3 DD, 14 D, 355/16, 38 F; 222/DIG. 1, 171

[56] References Cited

U.S. PATENT DOCUMENTS

| | | | |
|---|---|---|---|
| 4,101,215 | 7/1978 | Fottner et al. | 355/15 |
| 4,108,546 | 8/1978 | Rezanka | 355/15 |
| 4,190,351 | 2/1980 | Macaluso et al. | 355/15 |
| 4,213,794 | 7/1980 | Wooding et al. | 355/15 X |
| 4,252,435 | 2/1981 | Manghirmalani | 355/15 |
| 4,281,918 | 8/1981 | Fortmann | 355/15 X |

*Primary Examiner*—A. C. Prescott
*Attorney, Agent, or Firm*—James E. Nilles

[57] ABSTRACT

A toner recovery device having a non-magnetic rotary member, magnets embedded around the circumferential surface of said non-magnetic rotary member, and an endless belt wound on said rotary member so as to recover a toner collected by a cleaning device into a developing unit. A plurality of protuberances are equidistantly and projectingly formed around the circumferential surface of said rotary member to prevent said endless belt from floating as a whole. The protuberances drive said endless belt.

9 Claims, 6 Drawing Figures

TONER RECOVERY DEVICE

BACKGROUND OF THE INVENTION

1. Field of the Invention:

This invention relates to a toner recovery device for recovering a toner collected by a cleaning device of an electrostatic recording apparatus such as an electrophotographic copying machine into a developing unit and more specifically, to an improvement to a toner recovery device disclosed in Japanese Patent Application Laid-Open No. 30,161/1981.

2. Description of the Prior Art:

The toner recovery device disclosed in Japanese Patent Application Laid-Open No. 30,161/1981 will first be described broadly with reference to the FIGS. 1 and 2 thereof before the present invention is explained.

In the drawings, reference numeral 1 represents a photosensitive drum as a charge receptor. On the circumferential surface of this photosensitive drum 1 are disposed, sequentially and adjacent one another in the rotating direction of the drum, a charging electrode 2, an exposure optical system 3, a developing unit 4, a paper feeding device 5, a transfer electrode 6, a separation electrode 7, a transfer paper conveyor device 8, a charge eliminating electrode 9 and a cleaning device 10, in order named. The developing unit 4 accommodates a two-component system developing agent containing a magnetic carrier and an electrostatic toner and is equipped with a magnetic brush device 11 for forming ears of the electrostatic toner around the circumferential surface and with agitating blades 12 for generating the frictional charge of the electrostatic toner. A screw conveyor 13 for uniformly distributing the recovered toner is disposed at the upper part of the developing unit 4. The cleaning device 10 is equipped with a blade 15 placed in a container 14 and having its tip placed on the circumferential surface of the photosensitive drum 1. The toner scraped off from the circumferential surface of the photosensitive drum 1 by the blade 15 falls along a guide plate 16 and is collected at one of end portions of the container 14 by the screw conveyor 17 positioned at the bottom of the container 14.

The toner recovery device includes a case 18 consisting of a case main frame **18*a* and a cover 18*b* that are placed close to each other at one of end portions of the photosensitive drum 1, and a rotary member 19 made of a non-magnetic material, placed in this case 18. This rotary member 19 is driven by a sprocket 20 independently of the photosensitive drum 1 and is so constructed in a hollow as to be possessed of an outer diameter substantially equal to that of the photosensitive drum 1. Permanent magnets 21 having poles in the radial direction are equidistantly disposed on the inner circumferential surface of the rotary member 19. An endless belt 22 made of a non-magnetic material having flexibility is wound on the circumference of the rotary member 19 and is spread over an idler 23 and a tension roller 24 that are so supported by the case 18 as to face the screw conveyor 13**.

In the toner recovery device having such a construction, the ears of the developing agent are formed on the surface of the endless belt 22 as the rotary member 19 is driven for rotation, and the collected toner is catched into the ears of the developing agent on the surface of the endless belt 22, thereby effecting recovery of the toner. According to the tests and examination carried out by the inventors of the present invention, however, it was found that the toner could not much be recovered as expected. Though the case main frame **18*a* was made of an acrylic resin with the cover 18*b* being made of an iron sheet, the quantity of the toner recovered into the developing unit 4 was only small and the magnetic carrier in the developing unit 4 decreased gradually. When the case 18 was disassembled, a large quantities of developing agent was found inside the case 18. According to the results of analysis made by the inventors of the present invention, it was assumed that magnetic induction was generated on the cover 18*b* by the permanent magnets 21 of the rotary member 19 so that the developing agent that was being carried by the endless belt 22 was attracted to the cover 18*b* and thus accumulated in the case 18**.

It was also found that in the conventional toner recovery device, the recovery ratio gradually dropped. This was partly because the toners attaching to the endless belt 22 and the floating toners came into and between the circumferential surface of the rotary member 19 and the endless belt 22 along with the operation of the electrophotographic copying machine and these toners played the role of a lubricant and reduced the frictional force between the circumferential surface of the rotary member and the endless belt until at last the endless belt 22 no longer moved. Though the inventors of the present invention applied knurling work to the circumferential surface of the rotary member to cope with this problem, the toners entered the recesses of the knurling along with the operation of the copying machine, the result remaining substantially unaltered.

SUMMARY OF THE INVENTION

The present invention therefore proposes to construct the case, or the case main frame and the cover, by a non-magnetic material.

The present invention also proposes a rotary member having a simplified construction lest defective movement of the endless belt should occur during operation of the copying machine.

These and other objects and advantages of the present invention will become apparent from the following description and from the accompanying drawings.

DESCRIPTION OF THE PREFERRED EMBODIMENTS

Figure 1:
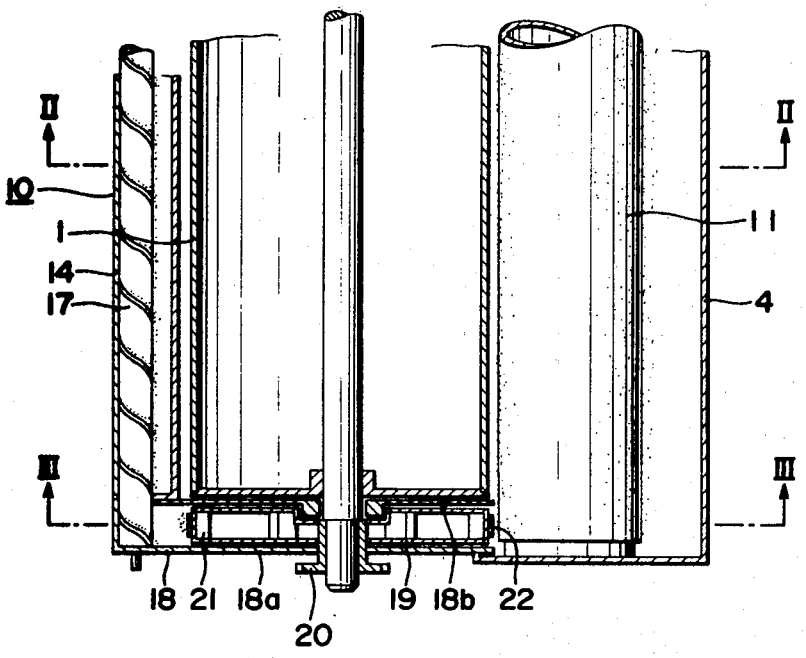
FIG. 1 is a sectional view of a toner recovery device.
Figure 2:
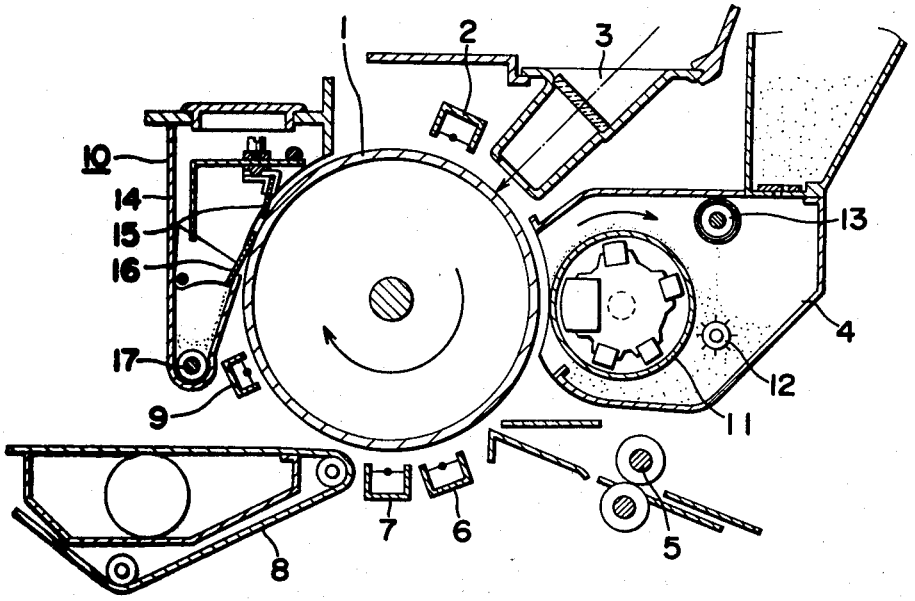
FIG. 2 is a sectional view taken along line II—II of FIG. 1.
Figure 3:
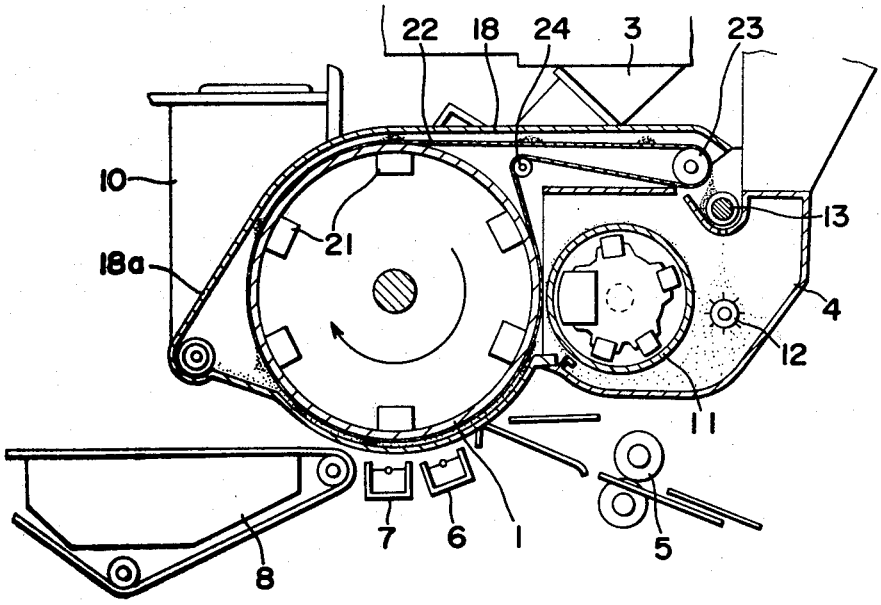
FIG. 3 is a sectional view taken along line III—III of FIG. 1.

In accordance with the present invention, both case main frame **18*a* and cover 18*b* are made of an ABS resin. When the copying tests were repeated using the recovery device of the present invention, the toner collected by the cleaning device 10 was found to have effectively been recovered in the developing unit 4. When the case 18 was disassembled to observe its internal condition after repeating the copying tests in a predetermined number of times, the developing agent was found attaching to the rotary member 19 and to the endless belt 22 but the inner surface of the case 18** was hardly contaminated by the toner.

Thus, the present invention can provide a toner recovery device eliminating the disadvantage that the recovery ratio of the toner drops with the operation of the copying machine.

Figure 4:
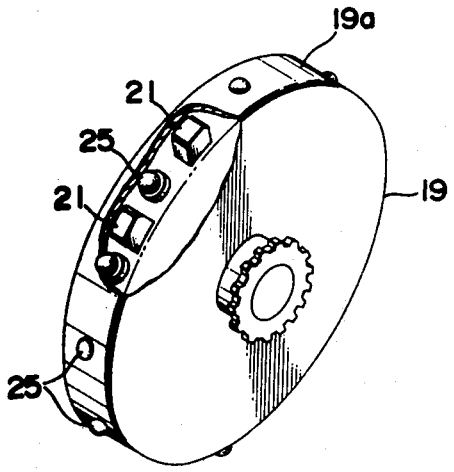
FIG. 4 is a perspective view of a rotary member.

FIG. 4 illustrates the rotary member 19 used for the toner recovery device in accordance with the present invention. This rotary member is made of a non-magnetic material in the form of a hollow disc and a plurality of permanent magnets 21 are equidistantly embedded around its inner circumference. Around the outer circumference 19*a* of the rotary member 19, there are disposed a plurality of protuberances 25 between adjacent pairs of permanent magnets 21 and at the center in the direction of width on the outer circumference 19*a*. These protuberances 25 are capable of engaging with the back of the endless belt 22 and are shaped semispherically lest the endless belt should float as a whole from the outer circumference 19*a*. Since the rotary member 19 in this embodiment has such a construction, those portions of the endless belt 22 which correspond to the permanent magnets 21 and the side portions of the endless belt come into intimate contact with the outer circumference 19*a* of the rotary member 19 so that the ears of the developing agent can be formed sufficiently on the surface of the belt and the toner is prevented from coming into and between the endless belt 22 and the outer circumference 19*a* of the rotary member 19. Even if the toner does come between them, the rotary member 19 is prevented from idling because a strong force of friction acts between the belt 22 and the protuberances 25.

Figure 5:
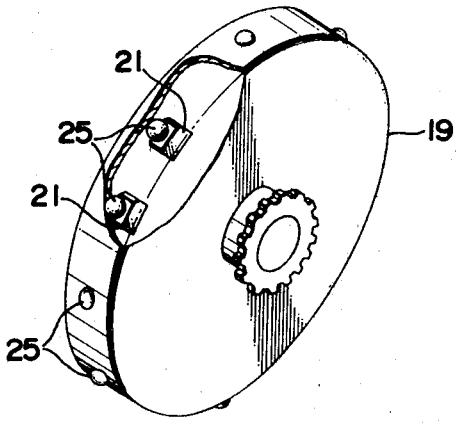
FIG. 5 is a perspective view of another embodiment of the rotary member.

FIG. 5 illustrates the rotary member 19 in accordance with the second embodiment of the present invention. The protuberances 25 in this embodiment are formed by shaping semispherically the tips of the permanent magnets 21. According to this arrangement, the flux density at the positions of the protuberances 25, that are brought into strong pressure contact with the endless belt, becomes great and the ears of the developing agent can effectively be formed at these positions.

Figure 6:
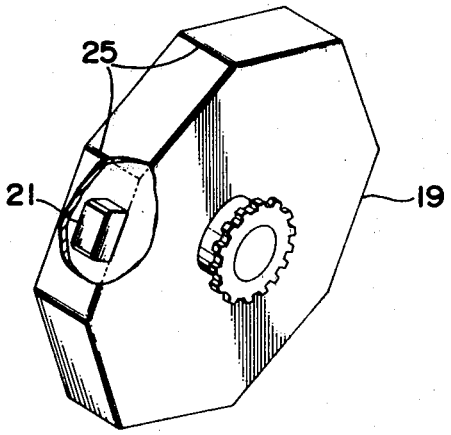
FIG. 6 is a perspective view of still another embodiment of the rotary member.

FIG. 6 illustrates the rotary member 19 in accordance with the third embodiment of the present invention. The rotary member 19 in this embodiment is an octagonal sheet, whose corners are made use of as the protuberances 25. It is obvious that this construction can also provide the same effect as the aforementioned embodiments.

As described in the foregoing, the present invention makes it possible to eliminate the defective movement of the endless belt by means of a rotary member having a simplified construction and to accomplish a toner recovery device having high durability.

What is claimed is:

1. In a toner recovery device in which a non-magnetic rotary member positioned coaxially with, and adjacent to, a charge receptor and having magnets embedded around the circumferential surface thereof is rotated and an endless belt wound on said rotary member is moved so as to recover a toner collected by a cleaning device into a developing unit, the improvement wherein a plurality of protuberances are equidistantly and projectingly formed around the circumferential surface of said rotary member to prevent said endless belt from floating as a whole, and said protuberances drive said endless belt.

2. The toner recovery device according to claim 1, wherein each of said protuberances is formed around the circumferential surface of the rotary member between said magnets in the rotary member.

3. The toner recovery device according to claim 1, wherein each of said protuberances is formed on each magnet of said magnets in the rotary member.

4. The toner recovery device according to claim 3, wherein each of said protuberances is formed by shaping semispherically the tip of each magnet of said magnets.

5. The toner recovery device according to claim 1, wherein said rotary member is an octagonal sheet, and each of said protuberances is a corner of said octagonal sheet.

6. The toner recovery device according to claim 1, wherein said device further comprises a case for accommodating therein the rotary member and the endless belt.

7. The toner recovery device according to claim 6, wherein said case is made of a non-magnetic material.

8. The toner recovery device according to claim 1, wherein said charge receptor is a photosensitive drum.

9. The toner recovery device according to claim 1, wherein said cleaning device comprises a blade placed in a container and having its tip placed on the circumferential surface of the charge receptor, and a guide plate for collecting a scraping toner.

* * * * *